US011751617B2

(12) United States Patent
Berkery

(10) Patent No.: US 11,751,617 B2
(45) Date of Patent: Sep. 12, 2023

(54) RETENTION POCKET FOR CLOTHING ARTICLES

(71) Applicant: James Edward Berkery, Smithers (CA)

(72) Inventor: James Edward Berkery, Smithers (CA)

( * ) Notice: Subject to any disclaimer, the term of this patent is extended or adjusted under 35 U.S.C. 154(b) by 0 days.

(21) Appl. No.: 16/996,844

(22) Filed: Aug. 18, 2020

(65) Prior Publication Data

US 2022/0053858 A1 Feb. 24, 2022

(51) Int. Cl.
*A41D 27/20* (2006.01)

(52) U.S. Cl.
CPC ..... *A41D 27/201* (2013.01); *A41D 27/205* (2013.01)

(58) Field of Classification Search
CPC .. A41D 27/201; A41D 27/205; A41D 27/207; A41D 27/208; A41B 1/08
USPC ..... 2/252
See application file for complete search history.

(56) References Cited

U.S. PATENT DOCUMENTS 2,840,824 A * 7/1958 Horner ..... A41D 27/20 2/247
3,477,068 A 11/1969 Rizzo
4,461,030 A * 7/1984 Knudsen ..... A45C 1/04 2/22
6,760,926 B1 7/2004 Miller
9,247,776 B1 2/2016 Kim
2005/0246823 A1 11/2005 Groom
2007/0083979 A1 4/2007 Daniels
2007/0180596 A1 8/2007 Shelton
2012/0185999 A1 7/2012 Raviv
2018/0027907 A1* 2/2018 Singer ..... A61L 9/12

* cited by examiner

*Primary Examiner* — Katherine M Moran
*Assistant Examiner* — Grady Alexander Nunnery
(74) *Attorney, Agent, or Firm* — Orin Del Vecchio

(57) ABSTRACT

A pocket configured to provide retention of an item in the interior volume thereof. The pocket of the present invention is formed having an outer wall adjacent to the body to which the pocket is secured. The pocket includes opposing lateral edges, a bottom edge and an upper peripheral edge wherein the upper peripheral edge defines the opening of the pocket. A first retention member is present along the upper peripheral edge and is configured to bias the upper peripheral edge against the body. An upper flap member is present and is vertically adjacent the upper peripheral edge. The upper flap member includes an upper edge, opposing side edge and a lower peripheral edge. The lower peripheral edge extends below the upper peripheral edge of the outer wall. A second retention seam member is present along the lower peripheral edge to bias against the outer wall.

6 Claims, 1 Drawing Sheet

RETENTION POCKET FOR CLOTHING ARTICLES

FIELD OF THE INVENTION

The present invention relates generally to clothing articles in particular portions thereof, more specifically but not by way of limitation, a retention pocket for an article of clothing such as but not limited to a shirt wherein the retention pocket is configured to receive and releasably secure an article such as but not limited to a cellular phone within the interior volume thereof.

BACKGROUND

Clothing articles are well known in the art. Items such as but not limited to jackets, shirts and pants come in numerous different styles. Many of the aforementioned articles of clothing have various different elements and features with one of the most common being pockets. Pockets are formed in articles of clothing utilizing numerous different techniques and can be ornamental or provide true function so as to receive objects therein. Conventional pocket design typically creates an opening providing access to an interior volume. The interior volume can be formed by either the existing material of the article of clothing or by additional material but regardless the end structure consists of an opening providing access to the interior volume of the pocket.

Conventional pocket designs for clothing typically have a bordered opening wherein there is a seam present adjacent the opening and elements such as but not limited to stitching may be present to provide a desired appearance as well as some additional structure to the opening. One problem with conventional pockets is there inability to provide secure retention of items placed therein. By way of example but not limitation, conventional shirt pockets are typically loose in form and if a person places an article therein and subsequently bends over, it is quite common for any article present within the pocket to fall out. While this may present an inconvenience, it further can cause damage to an article of higher value such as but not limited to cellular phones. Conventional pocket design does not provide secure retention of articles when a person may be manipulating the body position in those other than upright.

Accordingly, there is a need for a pocket design for an article of clothing such as but not limited to a shirt wherein the pocket design is configured to provide retention of an article ensuing disposal within the interior volume thereof.

SUMMARY OF THE INVENTION

It is the object of the present invention to provide a retention pocket formed in an article of clothing such as but not limited to a shirt wherein the retention pocket includes an outer wall that is adjacent to the shirt body.

Another object of the present invention is to provide a pocket configured to inhibit the unintended egression of items placed therein wherein the pocket of the present invention includes an upper flap portion.

A further object of the present invention is to provide a retention pocket formed in an article of clothing such as but not limited to a shirt wherein the outer wall is secured to the article of clothing on three sides and the fourth side proximate the top end has an opening providing access to the interior volume.

Still another object of the present invention is to provide a pocket configured to inhibit the unintended egression of items placed therein wherein the outer wall includes an upper peripheral edge along the opening of the pocket.

An additional object of the present invention is to provide a retention pocket formed in an article of clothing such as but not limited to a shirt wherein a retention seam member is present along the upper peripheral edge of the opening.

Yet a further object of the present invention is to provide a pocket configured to inhibit the unintended egression of items placed therein wherein the upper flap portion is vertically adjacent the upper peripheral edge.

Another object of the present invention is to provide a retention pocket formed in an article of clothing such as but not limited to a shirt wherein the upper flap portion includes a wall member adjacent to the article of clothing and a void is present therebetween.

Still an additional object of the present invention is to provide a pocket configured to inhibit the unintended egression of items placed therein wherein the upper flap portion includes a lower peripheral edge.

A further object of the present invention is to provide a retention pocket formed in an article of clothing such as but not limited to a shirt wherein a second retention seam member is present along the lower peripheral edge of the upper flap portion.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 2:
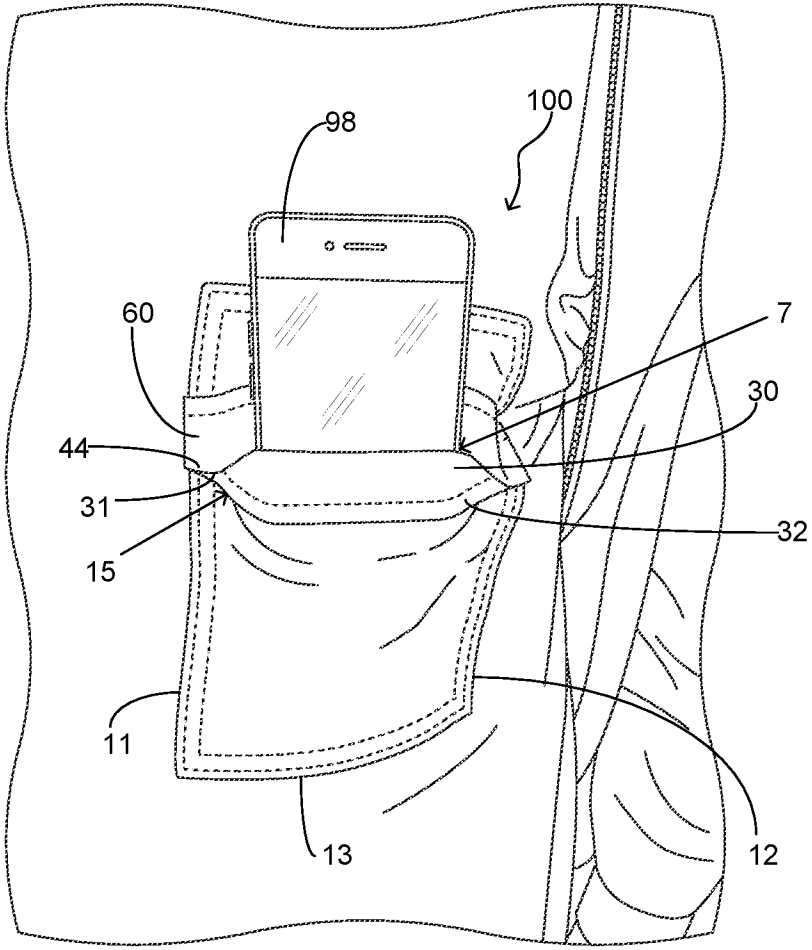
FIG. 2 is a front perspective view of the present invention with an object in process of being inserted therein.
Figure 1:
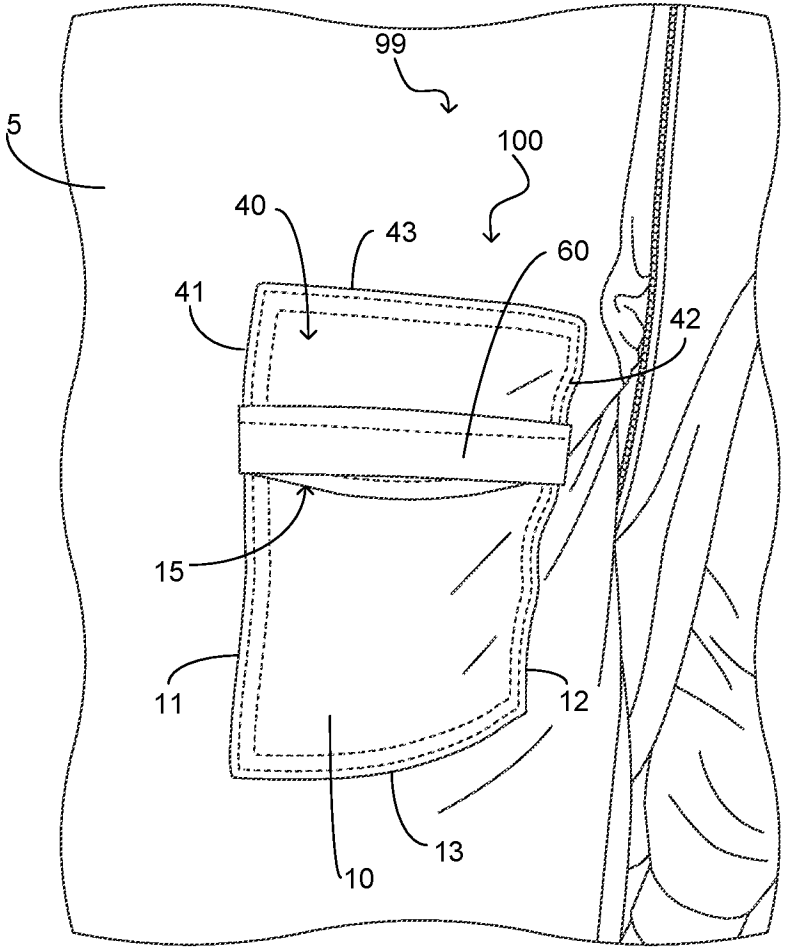
FIG. 1 is a front perspective view of the present invention.

Referring now to the drawings submitted herewith, wherein various elements depicted therein are not necessarily drawn to scale and wherein through the views and figures like elements are referenced with identical reference numerals, there is illustrated a retention pocket 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted as a part hereof, the retention pocket 100 includes an outer wall 10. The outer wall 10 includes opposing lateral edges 11, 12, a bottom edge 13 and an upper peripheral edge 15. The outer wall is secured to the body 5 of the exemplary article of clothing 99 utilizing suitable techniques such as but not limited to stitching. The stitching along the opposing lateral edges 11, 12 and the bottom edge 13 creates the interior volume of the retention pocket 100 that is configured to receive articles therein. While the retention pocket 100 is illustrated herein as being rectangular in shape, it should be understood within the scope of the present invention that the retention pocket 100 could be formed in alternate shapes and sizes and achieve the desired objective discussed herein.

Secured to the upper peripheral edge 15 is the first retention seam member 30. The first retention seam member 30 extends intermediate the opposing lateral edges 11, 12 and is configured to have an elasticity thereto. It should be understood within the scope of the present invention that the first retention seam member 30 is manufactured from a material having an elastic property. The first retention seam member 30 includes a first end 31 and a second end 32 wherein the first end 31 and second end 32 are secured to the body 5 and the outer wall 10 utilizing a suitable durable technique such as but not limited to stitching. The first retention seam member 30 is configured to provide a biased force against the body 5 of the exemplary article of clothing 99 wherein the first retention seam member 30 functions to bias the upper peripheral edge 15 of the outer wall 10 against the body 5. The aforementioned provides a first technique of closure of the opening 7 of the retention pocket 100. It is contemplated within the scope of the present invention that the first retention seam member 30 could be manufactured from alternate types of material such as but not limited to spandex.

The retention pocket 100 further includes an upper flap portion 40. The upper flap portion 40 includes opposing lateral edges 41, 42 and upper edge 43 being contiguously formed wherein the opposing lateral edges 41, 42 and upper edge 43 are secured to the body 5 utilizing durable techniques such as but not limited to stitching. The upper flap portion 40 includes lower peripheral edge 44 that is configured to extend over the upper peripheral edge 15. Secured to the upper flap portion 40 at the lower peripheral edge 44 thereof is the second retention seam member 60. The second retention seam member 60 extends intermediate the opposing lateral edges 41, 42 and is configured to provide a second technique to secure the exemplary object within the interior volume of the retention pocket 100. The second retention seam member 60 is manufactured from a material having an elastic quality such as but not limited to spandex or blend thereof. The second retention seam member 60 biases the lower peripheral edge 44 against the first retention seam member 30 and as such provides additional security to inhibit the opening 7 from allowing the exemplary object 98 egress from the retention pocket 100 without a user engaging the first retention seam member 30 and second retention seam member 60. In particular, in order to remove the exemplary object from the retention pocket 100, a user must engage the first retention seam member 30 and second retention seam member 60 and bias in opposing directions in order to provide access to the opening 7 so as either to facilitate insertion or removal of the exemplary object 98 into or from the retention pocket 100. The aforementioned configuration provides improved security of the exemplary object 98 when compared to utilization of a single retention member.

It should be understood within the scope of the present invention that while in the preferred embodiment the retention pocket 100 is formed on a shirt, that the retention pocket 100 could be formed on various articles of clothing. Furthermore, while the preferred embodiment of the retention pocket 100 has a first retention seam member 30 and a second retention seam member 60, the retention pocket 100 could be formed with only one retention seam member and still achieve the desired objective discussed herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A pocket on an article of clothing operable to releasably secure an object within an interior volume thereof wherein the pocket comprises:

an outer wall, said outer wall being adjacent a body of the article of clothing, said outer wall having opposing lateral edges, said outer wall having a bottom edge, said opposing lateral edges and said bottom edge being contiguously formed, wherein the pocket has an opening opposite said bottom edge, said opening providing access to said interior volume, said opening being defined by an upper peripheral edge; and a first retention seam member, said first retention seam member being present along said upper peripheral edge, said first retention seam member having a first end and a second end, said first retention seam member being manufactured from an elastic material, said first retention seam member configured to bias said opening against said body;

an upper flap portion, said upper flap portion being vertically adjacent said outer wall, said upper flap portion having an upper edge and a pair of opposing lateral edges, said upper flap portion further having a lower peripheral edge configured to extend beyond said upper peripheral edge of said outer wall;

a second retention seam member, said second retention seam member being secured to said upper flap portion along said lower peripheral edge thereof such that only the second retention seam member on the upper flap portion overlaps the first retention seam member when the pocket is closed.

2. The pocket on an article of clothing as recited in claim 1, wherein said second retention seam member is manufactured from an elastic material so as to bias against said outer wall.

3. The pocket on an article of clothing as recited in claim 2, configured such that a user may engage the second retention seam member and the first retention seam member and move thereapart in order to remove an item that has been placed in the interior volume of the pocket.

4. A pocket on a shirt configured to releasably secure an object within an interior volume thereof wherein the pocket comprises:

an outer wall, said outer wall being adjacent a body of the shirt having a void therebetween forming the interior volume, said outer wall having opposing lateral edges, said outer wall having a bottom edge, said opposing lateral edges and said bottom edge being contiguously formed, wherein the pocket has an opening opposite said bottom edge, said opening providing access to said interior volume, said opening being defined by an upper peripheral edge;

a first retention seam member, said first retention seam member being present along said upper peripheral edge, said first retention seam member having a first end and a second end, said first retention seam member being manufactured from an elastic material, said first retention seam member configured to bias said opening against said body;

an upper flap portion, said upper flap portion being vertically adjacent the upper peripheral edge of said outer wall, said upper flap portion having an upper edge and a pair of opposing lateral edges, said upper flap portion further having a lower peripheral edge configured to extend below said upper peripheral edge of said outer wall; and a second retention seam member, said second retention seam member being secured to said upper flap portion along said lower peripheral edge thereof, said second retention member having a first end and a second end, said second retention member configured to bias the lower peripheral edge of said upper flap portion against said outer wall such that only the second retention seam member on the upper flap portion overlaps the first retention seam member when the pocket is closed.

5. The pocket on the shirt as recited in claim 4, wherein the second retention member is manufactured from an elastic material.

6. The pocket on the shirt as recited in claim 5, wherein the pocket is configured to be provided in alternate shapes and sizes.

* * * * *